US005377785A

United States Patent [19]

Pearson

[11] Patent Number: 5,377,785

[45] Date of Patent: Jan. 3, 1995

[54] DOOR CLOSING SYSTEM

[75] Inventor: David B. Pearson, Morristown, N.J.

[73] Assignee: Inventio AG, Hergiswil, Switzerland

[21] Appl. No.: 89,646

[22] Filed: Jul. 12, 1993

[51] Int. Cl.[6] ..... B66B 13/00

[52] U.S. Cl. ..... 187/308; 49/116; 187/335

[58] Field of Search ..... 187/61, 57, 51, 59, 187/52 LC; 49/116, 120, 366

[56] References Cited

U.S. PATENT DOCUMENTS

| | | | |
|---|---|---|---|
| 18,744 | 9/1862 | Waygood et al. | 187/61 |
| 2,003,399 | 6/1935 | Tamsitt | 187/61 |
| 2,899,021 | 8/1959 | O'Grady | 187/52 |
| 3,721,319 | 3/1973 | Hall et al. | 187/61 |
| 4,313,525 | 2/1982 | McDonald | 187/57 |
| 4,926,974 | 5/1990 | Morris et al. | 187/61 |
| 4,934,488 | 6/1990 | Umemura | 187/61 |
| 5,139,112 | 8/1992 | Tonna et al. | 187/61 |

FOREIGN PATENT DOCUMENTS

| | | | |
|---|---|---|---|
| 164581 | 12/1985 | European Pat. Off. | 187/61 |
| 0484169 | 5/1992 | European Pat. Off. . | |
| 3031188 | 2/1991 | Japan . | |

OTHER PUBLICATIONS

Patent Abstracts of Japan, vol. 15, No. 160 (M-1105)22, published 22 Apr. 1991.

European Search Report and Annex.

*Primary Examiner*—Kenneth W. Noland

*Attorney, Agent, or Firm*—Sandler, Greenblum & Bernstein

[57] ABSTRACT

A door closing system for subsequent installation on an automatic sliding door of an elevator car is coupled, at floor stops, via cams and couplings with the hoistway door and is opened and closed together therewith, wherein the closing system prohibits opening of the elevator door from the inside of the car when the car is between two floors, i.e., outside the door opening zone of a floor, wherein a rocker mechanism is affixed to a fixed or movable cam of the clutch and coupling mechanism of the door, the rocker mechanism being tilted by coupler brackets of the hoistway door during normal operation of the door within the door opening zone and, via a transfer means, removes a locking pawl from a hook retainer and thus mechanically frees the door for opening, with the rocker mechanism not being actuatable outside of the door opening zone and blocking the car door via the locking pawl that is kept in a mechanically interlocked position via a compression spring.

8 Claims, 3 Drawing Sheets

DOOR CLOSING SYSTEM

BACKGROUND OF THE INVENTION

1. Field of the Invention

A door closing system for subsequent installation on an automatic sliding door of an elevator car which, at floor stops, is coupled via cams and couplings with the hoistway door and is opened and closed together therewith, wherein the closing system prohibits opening and closing of the elevator door from the interior of the car when the latter is between two floors, i.e., beyond the door opening zone of a floor.

2. Discussion of the Background of the Invention and Material Information

Automatic door systems on elevators which conform to the current state of the art and to current regulations are constructed and equipped to meet the retirement that elevator passengers be unable to open the car door when the car is beyond the door opening zone of a floor. Since these retirements and regulations are not very old there remain very many elevator installations that no longer meet these terms, but however are still fully functional and operational for years to come.

The door systems of such elevator installations must however be adapted to the present regulations which presents the problem of a practical and cost effective solution. Generally, it is desired to update the non-regulation conforming door systems to the currently required safety standard with the smallest possible intrusion into the existing construction and with the use of the fewest additional parts.

U.S. Pat. No. 4,313,525 presents such a solution. However, it pertains to an automatic elevator sliding door of nodal known construction. A horizontally reversible coupling arrangement on the car door is brought to an operating position by the door drive in front of a stop and at the door opening zone of a floor stop, with the use thereof of a clutched coupling and unlocking rollers, the hoistway and car doors are opened. At the beginning of the opening sequence the right coupling cam on the car door touches the right unlocking roller of the hoistway door. In the further process of the opening movement, the right coupling cam, journalled in a parallelogram, is pressed to the right and simultaneously is lifted upwardly. A vertical connecting rod, mechanically coupled with the right coupling cam is also moved upwardly and lifts a locking pawl from an engaged position, whereby the car door is mechanically unlocked.

The thus described solution is directed to fulfilling the previously noted requirements. A general utilization appears to be impossible however, since for the unlocking of a member, vertical movement in engagement with the hoistway door is required, so that the presented solution is obviously not usable for universal subsequent installation.

SUMMARY OF THE INVENTION

An object of the present invention, therefore, has the objective to produce a door closing system which can be subsequently added to most existing non-regulation conforming door systems that does not require changes in the existing construction, which is simple and safe, and which can be installed with the least expenditure of time and materials.

The advantages obtained as a result of this invention primarily reside therein that the subsequent installation of this equipment needs no engagement or contact with the existing construction, that the equipment can be installed in a short time and can be produced simply and inexpensively.

The aforementioned object of this invention is achieved by a door closing system for subsequent installation on an automatic sliding door of an elevator car which, at floor stops, is coupled via cams and couplings with the hoistway door and is opened and closed together therewith, wherein the closing system prohibits opening and closing of the car door from the interior of the car when the car is between two floors, that is beyond the door opening zone of a floor, the door closing system including: a rocker mechanism which is activated in the door opening zone, at the time of door opening, by a coupling system at the hoistway door; means for transmitting, activated by the rocker mechanism; a locking pawl, activated by the means for transmitting; and a hook retainer, with the locking pawl being engaged with the hook retainer.

Specifically, in one embodiment of the present invention the means for transmitting includes a drawing wire, with the drawing wire being comprised of a wire cable, a cable sheath, clip and a compression spring. The means for transmitting may also take the form of a cable pulley, or may take the form of a push-pull mechanism.

In the embodiments of the present invention the rocker mechanism includes a tension leg and a pressure leg, with the rocker mechanism being movably mounted at a pivot and having a fixed, constant angle between the tension leg and the pressure leg, with the pressure leg including a facet on both the upper and lower ends thereof.

The embodiments also include a movable cam, with the rocker mechanism being retained on this movable cam.

The embodiments further include a fixed cam, with the rocker mechanism being retained on this fixed cam.

Finally, in one embodiment of the present invention the locking pawl includes an adjusting bolt and the hook retainer includes at least one striker edge.

BRIEF DESCRIPTION OF THE DRAWINGS

The invention will be better understood and objects other than those set forth above will become apparent when consideration is given to the following detailed description thereof. Such description makes reference to the annexed, drawings wherein throughout the various figures of the drawings, there have generally been used the same reference characters to denote the same or analogous components. The drawings illustrate two specific examples or embodiments wherein.

DETAILED DESCRIPTION OF THE PREFERRED EMBODIMENTS

Figure 1:
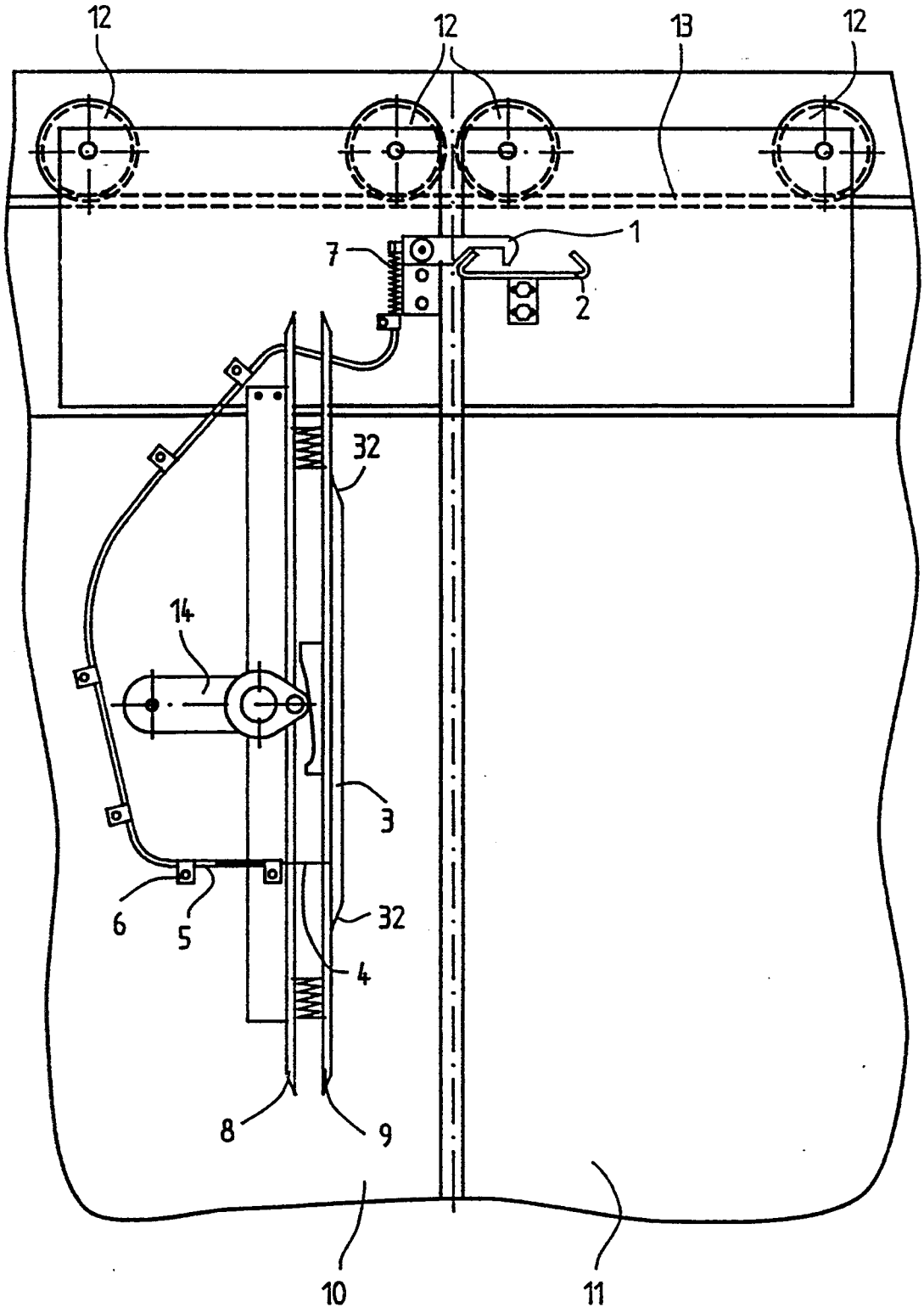
FIG. 1 is a frontal view of an automatic elevator car door with the subsequently installed system of the present invention.

FIG. 1 shows a centrally opening elevator sliding door with a left door leaf or half 10 and a right door leaf of half 11. Both door halves 10 and 11 are hung or suspended with rollers 12 which travel on a rail 13 and are opened and closed via a non-illustrated door drive system. Mounted on the left door half or leaf is the clutch and coupling system which is basically comprised of a fixed cam 8, a movable cam 9 and a cam actuator 14. The door closing mechanism installed on this automatic door includes a hook retainer 2 attached at the upper left of the right door half 11, a locking pawl 1 attached at the upper right of the left door half 10 and shown in a locking position, a compression spring 7 for keeping locking pawl i in a locking position, a drawing wire or cable sheath 5 which is attached to the left door half 10 with a clips or shackles 6, a drawing wire or cable 4 movable within sheath 5 and a whip, balance or rocker mechanism 3 which is mounted on movable cam 9 and which activates cable 4. Rocker mechanism 3 includes an inclined surface or facet 32 on both its upper and lower ends.

Figure 2:
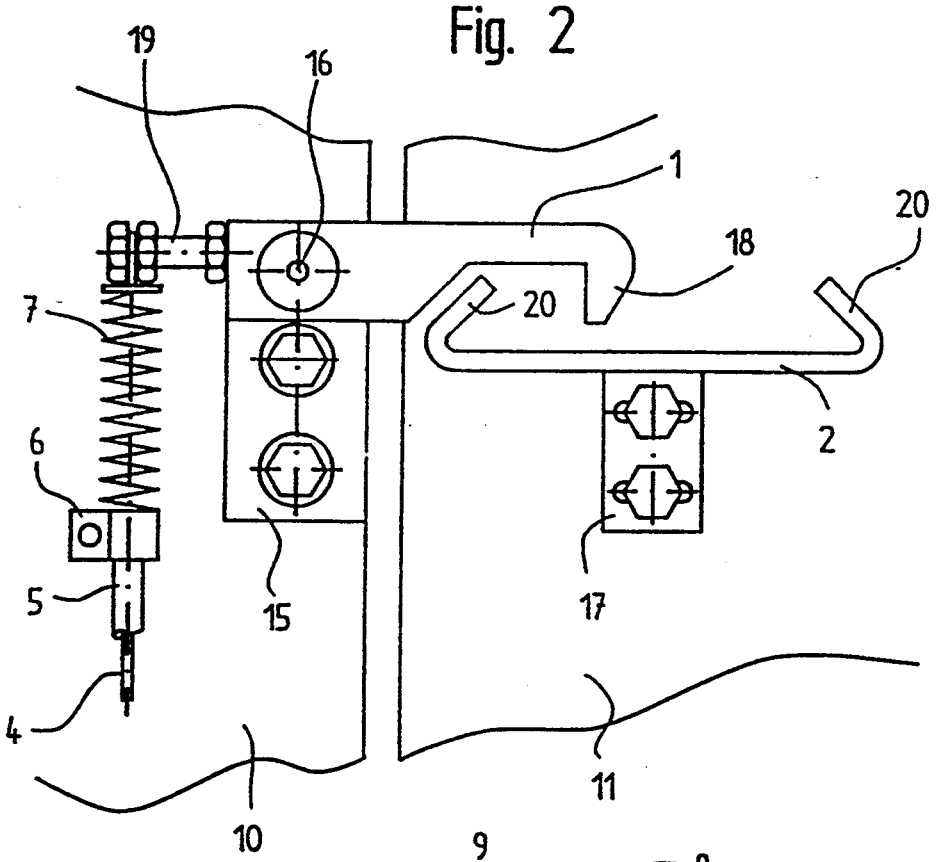
FIG. 2 is an enlarged section of a portion of this system.

FIG. 2 shows the closing mechanism with its corresponding parts. Hook retainer 2 includes an attachment support 17, for mounting the retainer 2 to the door half half 11, as well as a horizontal portion having opposed left and right upwardly bent striker edges 20. The right striker edge has no function in the present arrangement but serves however for the universal utilization of hook retainer 2 for both left and right hand usage. Locking pawl 1 is movably journalled, at fulcrum or pivot point 16, on a support 15 mounted on the left door half. The right end of locking pawl is provided with a nose or hook 18 which is downwardly directed and extends beyond striker edge 20. The left portion of locking pawl i includes an adjusting bolt 19 with a bolt head, retainer and jam nuts. Compression spring 7 is retained between clip 6 and the bolt head of adjusting bolt 19 and keeps locking pawl 1 in the shown engaged position. Drawing wire or cable 4 has its end formed as an eye ring which is retained between the bolt head and nut of adjusting bolt 19. Bolt 19 can be used to change the leverage by appropriately extending or retracting the effective length thereof.

Figure 3:
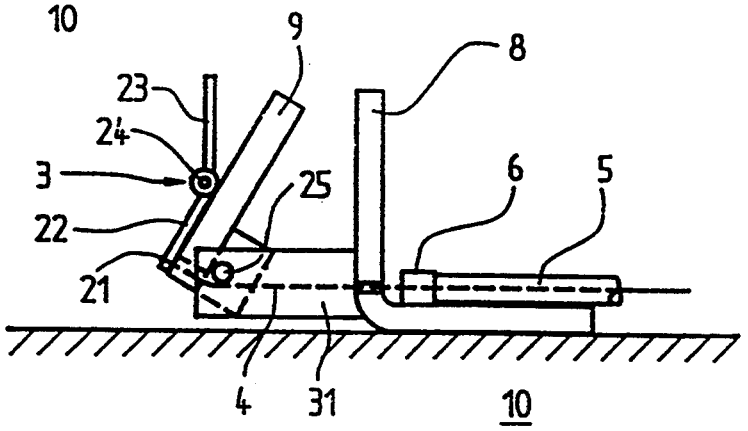
FIGS. 3, 4 and 5 show the condition and function of the clutch and coupling mechanism in three different situations with a subsequently/installed first variation of this invention.

FIG. 3, which shows the clutch and coupling mechanism in cross section also shows a pivot support 31, extending to the left of fixed cam 8 having a pivot point 25, about which movable cam 9 is movable, within a limited angle. In the illustration of FIG. 3, movable cam 9 is positioned as shown during operation of the elevator. The rocker mechanism 3 is attached to the left side of movable cam 9 and is comprised of an upwardly directed pressure leg 23 and a downwardly directed tension leg 22. The two legs 22 and 23 of rocker mechanism 3 are arranged at a fixed, constant angle of, for example, 130° to 150° relative to each other. Although not shown in FIG. 3, rocker mechanism 3 has a vertical length of, for example, 40 to 60 cm and can move about pivot point 24 within a limited angle of, for example, 30° to 60°. At the lower end tension leg 22 of rocker mechanism 3 an aperture permits the passage of cable 4, which is kept from being pulled out by a retainer 21. The end of cable sheath 5 is attached, via clip 6, on the horizontal portion of fixed cam 8 near its bend. The illustrated system is located at the left door half 10.

Figure 4:
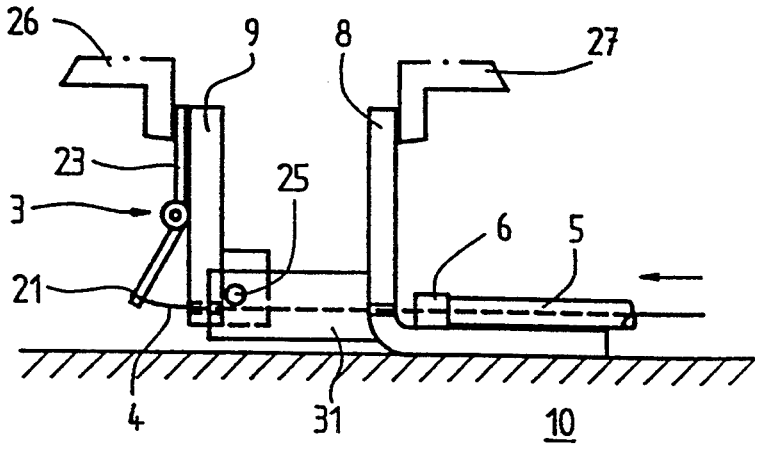

FIG. 4 illustrates, in broken lines, the addition of a left and right coupler bracket 26 and 27, respectively, for use as a hoistway door coupling system. In the illustrated position, the car door is coupled to the non-illustrated hoistway door and the rocker mechanism 3 is tilted or tipped via left coupler bracket 26 and cable 4 is pulled a predetermined amount to the left.

Figure 5:
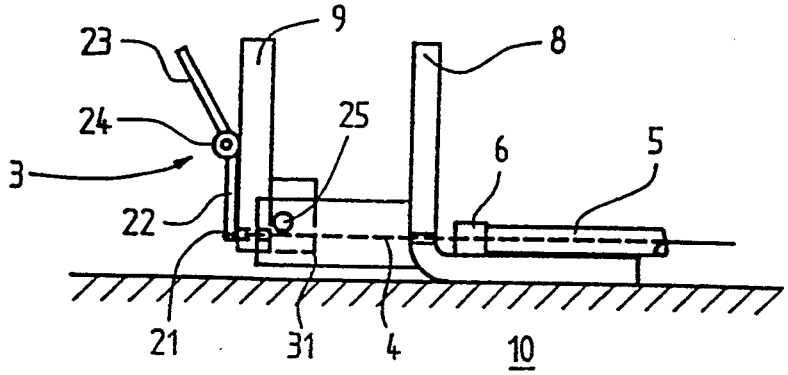

In FIG. 5, movable cam 9 is in the unfolded or spread position. Rocker mechanism 3 is not tilted or tipped since the elevator is outside of or beyond the door zone.

Figure 6:
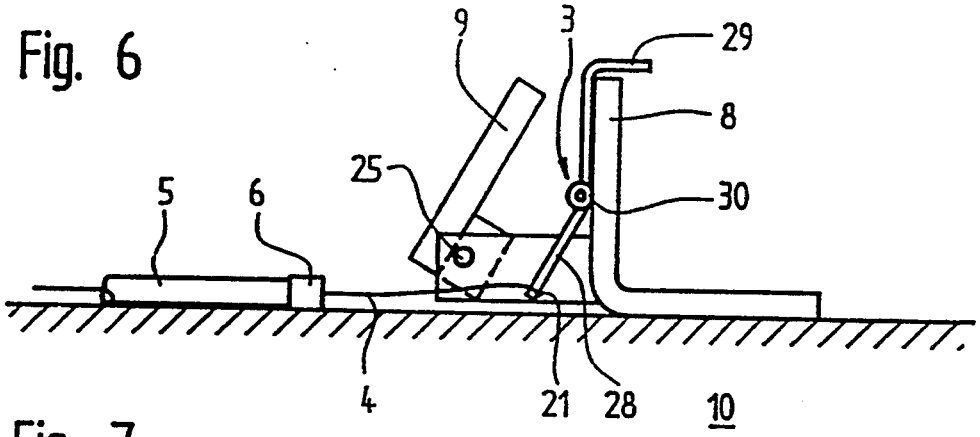
FIGS. 6, 7 and 8 show the condition and function of the clutch and coupling mechanism in three different situations with a subsequently installed second variation of this invention.
Figure 7:
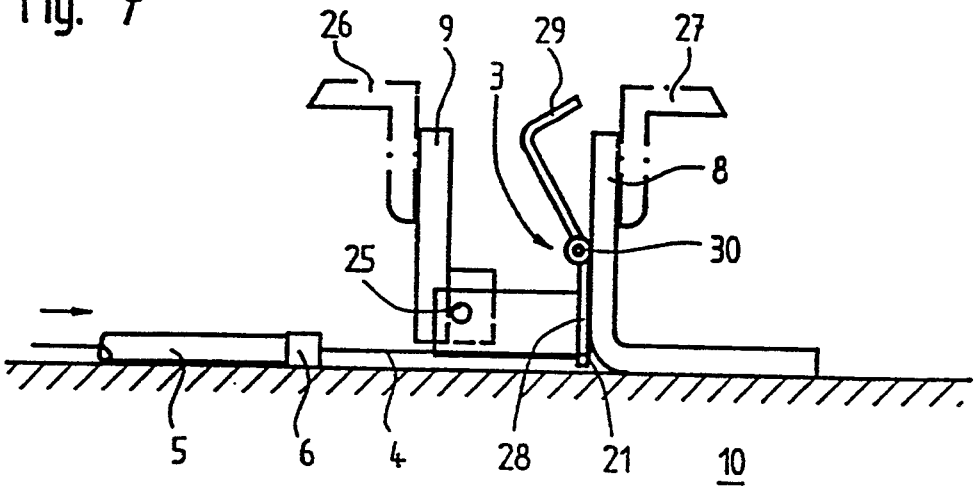
Figure 8:
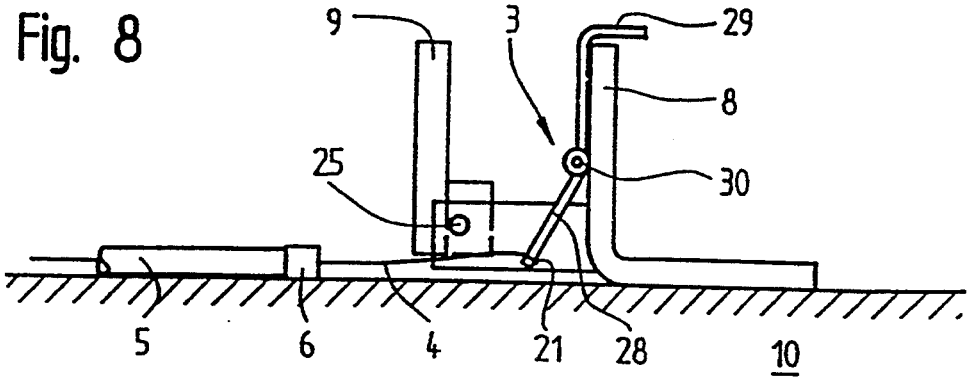

FIGS. 6, 7 and 8 show the same situation as FIGS. 3, 4 and 5, with the difference being that rocker mechanism 3 is attached to the left flank or side of fixed cam 8 and has a pressure leg 29 with an angled or bent upper end, which covers the upper or front side of fixed cam 8 to the right. Here rocker mechanism 3 can move about pivot point 30. In addition, the end of cable sheath 5 is attached on the left in surface of door half 10 with clip 6.

The previously described system functions as follows: As a wire or cable element, a high quality cable sheath, having an external, protective, layered spiral spring and an internal low friction Teflon coating is utilized. As a pulling wire or cable, a smooth and corrosion-resistant steel spring wire, easily slidable in the cable sheath, is utilized. The cabin door can be freed or released for manual opening when rocker mechanism 3 is tilted or shifted via the power reaction on pressure leg 23 and 29 respectively, it follows that cable 4 of tension leg 22 is pulled a predetermined amount out of sheath 5 and is pulled into sheath 5 at the upper end thereof and against the force of compression spring 7, which pulls the left side of locking pawl 1, with bolt 19, downwardly and pulls nose or hook is, on the right side of locking pawl 1 out of the rear engagement of the bent striker edge 20 of hook retainer 2, whereby the cabin or car door, respectively door halves 10 and 11, can be pushed open manually.

During normal operation of the elevator, the car runs with its clutch and coupling mechanism and with its movable cam in an outwardly swing position, according to FIGS. 3 and 6, between coupler brackets 26 and 27 of the hoistway door of a floor stop and then pivots movable cam 9 into the coupling position as per FIGS. 4 and 7. In this position, rocker mechanism 3 is pressed into the illustrated position and the previously described procedure for the lifting of locking pawl takes place. Should the car remain between two stories, i.e., beyond the door-opening zone, for example because of a power outage, the door drive mechanism cannot produce a closing force and a non-mechanically blocked car door could be pushed open, as a result, as noted in the discussed state of the art, can lead to dangerous situations. The function of the inventive system in such an occurrence, can be explained with reference to FIGS. 5 and 8.

If the car is stopped beyond the door opening zone due to a power failure or a different reason, movable cam 9 assumes the power-absent normal position as illustrated in FIGS. 5 and 8. In this position, rocker mechanism 3 would be tilted, as per FIGS. 4 and 7, if the car were in a door zone. Since the car, however , is beyond the door zone, rocker mechanism 3 remains untouched in the illustrated position and locking pawl 1 is retained in its blocking position via the force of compression spring 7. When, during such a mishap the blocked car is manually brought to the next available step, from the machine room by a knowledgeable person, for the release of locked-in passengers, rocker mechanism 3, as a result of entering the next stop and the entrance into coupler brackets 26 and 27 of the hoistway door, is gradually pushed into the position that lifts locking pawl 1. This is possible since rocker mechanism 3 at pressure leg 23 and 29, on the upper and lower ends, each has a facet or an inclined surface 32 having a length of, for example, 5 to 10 cm. This surface, on the upper and lower end of pressure leg 23 is shown in FIG. 1.

The two variations of this invention differ from each other in that in the first variation, as per FIGS. 3, 4 and 5, rocker mechanism 3 is attached to movable cam 9, and, in the second variation, as per FIGS. 6, 7 and 8, rocker mechanism 3 is attached to fixed cam 8 with an angled pressure leg 29. Depending on the existing construction of the existing door drive system to be accommodated, one or other variation can be utilized.

In place of a cable or wire mechanism for the locking pawl actuation any available commercial means may be utilized, such as for example cable pulleys of all types or flexible pull-push elements functioning with sliding or rolling manner. In addition, this problem is also solvable with an open transmission with a flexible drawing means or flexible media 23, in the form of a cord, string or filament etc., or a wire cable which, for example, at the lower right, next to cam 8.

What is claimed is:

1. A door closing system for retrofit installation on an automatic sliding door of an elevator car which, at floor stops, is coupled via cams and coupler brackets with a hoistway door and is opened and closed together therewith, wherein the closing system prohibits opening and closing of the car door from the interior of the car when the car is between two floors, that is, beyond the door opening zone of a floor, said door closing system including:

a rocker mechanism, said rocker mechanism being activated in the door opening zone, at the time of door opening, by a coupling system at the hoistway door;

means for transmitting, activated by said rocker mechanism;

a locking pawl, activated by said means for transmitting;

a hook retainer, said locking pawl being engaged with said hook retainer; and said rocker mechanism including one of a fixed cam and a movable cam, with said rocker mechanism being retained on one of said fixed and movable cams.

2. The door closing system of claim 1 wherein said rocker mechanism includes a tension leg and a pressure leg, said rocker mechanism being movably mounted at a pivot point located at a joinder of proximate ends of said tension and pressure legs and having a fixed, constant angle between said tension leg and said pressure leg.

3. The door closing system of claim 2 wherein said rocker mechanism is retained on said movable cam.

4. The door closing system of claim 2 wherein said rocker mechanism is retained on said fixed cam.

5. The door closing system of claim 1 wherein said rocker mechanism is retained on said movable cam.

6. The door closing system of claim 1 wherein said rocker mechanism is retained on said fixed cam.

7. The door closing system of claim 1 wherein said locking pawl includes an adjusting bolt for adjusting the leverage of said locking pawl by adjusting the effective length thereof.

8. The door closing system of claim 1 wherein said hook retainer includes two oppositely directed striker edges.

* * * * *